US006708686B2

(12) United States Patent
Hepworth

(10) Patent No.: US 6,708,686 B2
(45) Date of Patent: Mar. 23, 2004

(54) POWER GLIDE TILE CUTTER

(75) Inventor: Paul S. Hepworth, Guildford (GB)

(73) Assignee: Turner Intellectual Property Limited, Staffordshire (GB)

( * ) Notice: Subject to any disclaimer, the term of this patent is extended or adjusted under 35 U.S.C. 154(b) by 0 days.

(21) Appl. No.: 10/214,879

(22) Filed: Aug. 8, 2002

(65) Prior Publication Data

US 2003/0029433 A1 Feb. 13, 2003

(30) Foreign Application Priority Data

Aug. 11, 2001 (GB) ..... 0119678

(51) Int. Cl.[7] ..... B28D 1/32; B26F 3/00

(52) U.S. Cl. ..... 125/23.02; 225/96.5; 83/886

(58) Field of Search ..... 125/23.01, 23.02, 125/35; 225/94, 96, 96.5; 83/886, 879

(56) References Cited

U.S. PATENT DOCUMENTS

| | | | | |
|---|---|---|---|---|
| 1,106,224 A | * | 8/1914 | Kizer | 33/32.3 |
| 1,995,741 A | * | 3/1935 | Granite | 125/23.02 |
| 3,998,497 A | | 12/1976 | Koizumi | |
| 4,693,232 A | * | 9/1987 | Yasuga | 125/23.02 |
| 5,394,781 A | | 3/1995 | Tsubai | |
| 5,505,359 A | | 4/1996 | Joecker, Jr. | |

FOREIGN PATENT DOCUMENTS

| | | |
|---|---|---|
| DE | 25 56 094 A | 12/1975 |
| EP | 0 523 010 A | 10/1992 |
| FR | 1363392 | 5/1964 |
| FR | 1580300 | 9/1969 |
| FR | 02 10216 | 2/1970 |
| FR | 2624049 | 12/1987 |
| FR | 2741836 A3 | 11/1996 |
| GB | 2 261 188 A | 11/1991 |
| GB | 2 311 485 A | 10/1996 |
| GB | 0119678.1 | 12/2001 |
| WO | WO 89/10235 | 11/1989 |

* cited by examiner

*Primary Examiner*—Hadi Shakeri
(74) *Attorney, Agent, or Firm*—Nikolai & Mersereau, P.A.; C. G. Mersereau

(57) ABSTRACT

A tile cutter includes a base having a support surface upon which tiles to be cut may be supported, a pair of guide rails mounted upon the base, the guide rails being parallel to one another and being spaced from the support surface to enable a tile to be located between the guide rails and the support surface. A cutter assembly is provided, mounted on a carriage, which, in turn, is movably mounted on the pair of rails so as to guide the cutter assembly along a rectilinear path across the support surface. The carriage includes a first rotary bearing assembly in rotary contact with one rail and a second rotary bearing assembly in rotary contact with the other rail. Each rotary bearing assembly includes at least one bearing in the form of a roller having a shaft on which is mounted at least one wheel which projects radially beyond said shaft and is axially fixed relation to the shaft, the wheel having an axial face, a circumferential face and a transition face extending between the axial and circumferential faces, the transition face being in rotary contact with the rail.

16 Claims, 7 Drawing Sheets

POWER GLIDE TILE CUTTER

BACKGROUND OF THE INVENTION

The present invention relates to a tile cutter, in particular but not exclusively, a tile cutter for ceramic tiles of the type used for covering walls or floors.

SUMMARY OF THE INVENTION

According to one aspect of the present invention there is provided a tile cutter comprising a base having a support surface upon which tiles to be cut may be supported, a pair of guide rails mounted upon the base, the guide rails being parallel to one another and being spaced from said support surface to enable a tile to be located between the guide rails and said support surface, a cutter assembly mounted on a carriage, the carriage being movably mounted on said pair of rails so as to guide said cutter assembly along a rectilinear path across said support surface, and said carriage including a first rotary bearing assembly in rotary contact with one rail and a second rotary bearing assembly in rotary contact with the other rail, each rotary bearing assembly including at least one bearing in the form of a roller having a shaft on which is mounted at least one wheel which projects radially beyond said shaft and is axially fixed relative to the shaft, the wheel having an axial face, a circumferential face and a transition face extending between said axial and circumferential faces, said transition face being in rotary contact with said rail.

Various aspects of the present invention are hereinafter described with reference to the accompanying drawings, in which:

DETAILED DESCRIPTION

Figure 1:
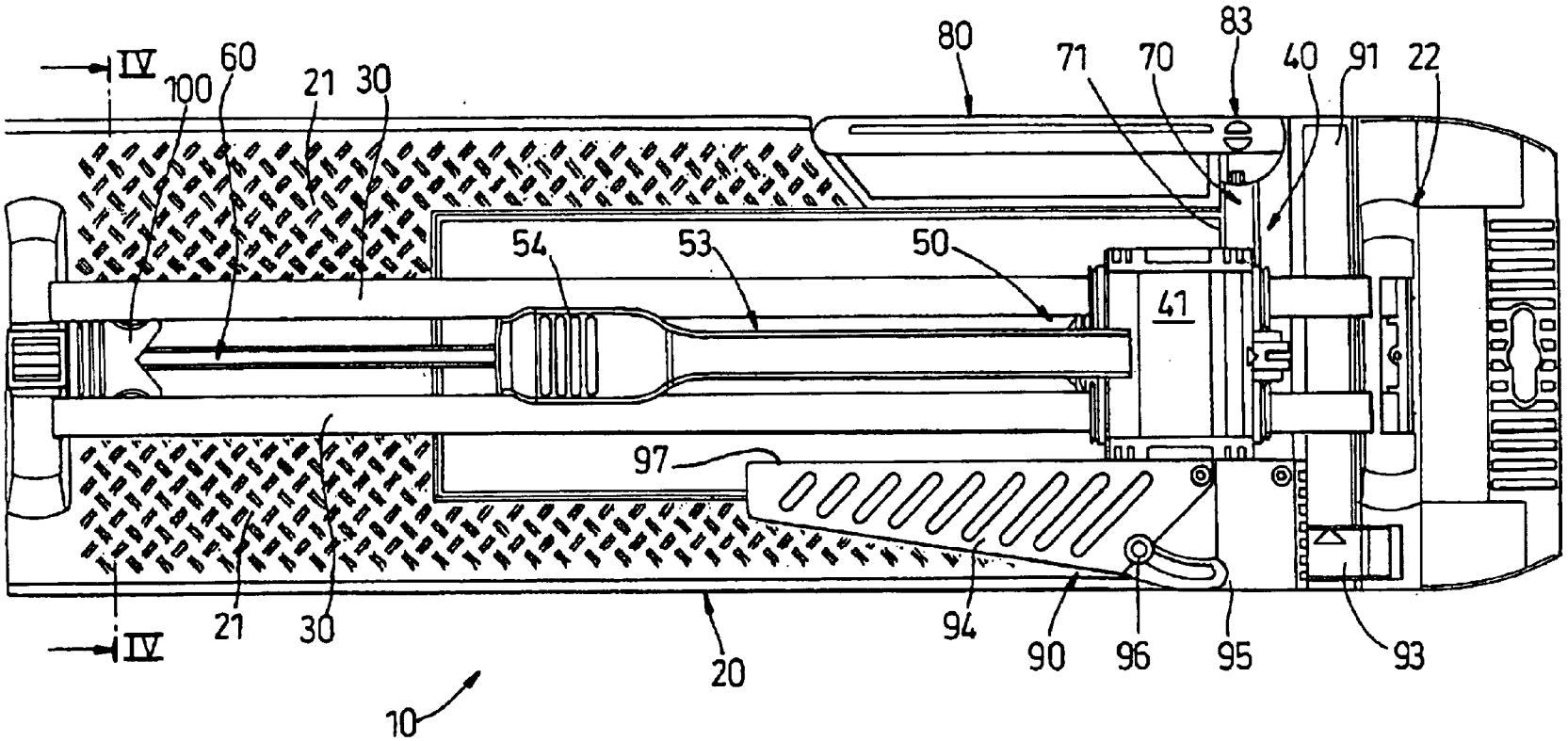
FIG. 1 is a plan view of a tile cutter according to an embodiment of the invention.

The tile cutter 10 according to a preferred embodiment of the present invention includes a base 20 which has an upper planar support surface 21 upon which tiles to be cut are placed.

A pair of guide rails 30 are mounted on the base 20 by a pair of bosses 22 into which opposed ends of the rails 30 are received.

The rails 30 are mounted so as to be parallel to one another and also parallel with the planar support surface 21.

The base 20 is preferably a plastics moulding and the bosses 22 are preferably also formed from plastics material and are preferably integrally moulded with the base 20.

This enables the position of the rails to be accurately and consistently reproduced for mass production.

Preferably the rails 30 are round in cross-section, preferably circular, and are preferably tubular. The rails 30 are preferably made form stainless steel so as to be resistive to corrosion and abrasive wear.

Alternatively, the rails 30 are polygonal in section.

Located on the guide rails 30 is a cutter carriage 40.

The cutter carriage 40 includes a carriage body 41 on which a cutter assembly 50 is mounted.

The cutter assembly 50 includes a cutter wheel 52 rotatably mounted on one end of a lever 53 which is pivotally mounted on the carriage body 41 via a pivotal connection. The opposite end of the lever 53 extends longitudinally of the rails 30 to define a handle 54.

Preferably the pivotal connection is located centrally of the carriage body 41 so as to position the cutter assembly 50 centrally between the rails 30.

The cutter wheel 52 has an axis of rotation perpendicular to the axis of the rails 30 so that movement of the carriage body 41 along the rails 30 causes the cutter wheel 52 to move along a rectilinear path in which the wheel 52 is maintained perpendicular to the base 20.

Preferably an elongate ridge 60 is provided on the base 20 which extends along the rectilinear path such that the wheel 52 is opposed to the ridge 60 during its travel along rails 30. Thus in use, when a tile is placed upon the base 20, it is supported upon ridge 60 and downward pressure applied by the cutter wheel 52 to score the tile as it travels along the rails 30 is opposed by the ridge 60.

Preferably the ridge 60 comprises a channel formation 62 integrally moulded with the base 20 and a rod 63 of a rigid wear resistant material mounted within the channel formation 62. Moulding the channel formation 62 integrally with the base 20 enables the ridge 60 to be accurately and consistently reproduced relative to the position of the rails 30 and cutter assembly 50 for mass production.

Insertion of a separate rod 63 enables a rod of a suitable material to be chosen, preferably the rod 63 is a solid rod of a suitable steel. After scoring of the tile, the rod 63 acts as a breaker bar for snapping the tile along a score line created by the cutter.

To enable snapping of the tile to be achieved, the lever 50 is preferably provided with a pressure foot 56 located on the opposite side of the lever's pivotal connection such that downward movement of the lever 50 enables the foot 56 to be brought into contact with the tile and for downward pressure to be applied thereto through foot 56.

Preferably the base 20 is provided with a raised land portion 70 which defines as tile positioning shoulder 71. The shoulder 71 extends in a rectilinear manner across the width of base 20 at an angle of 90° to the longitudinal axis of rails 30.

This enables a tile to be placed upon the base 20 with one side in abutment with the shoulder 71 and so accurately position the tile such that the cutter wheel 52 is able to score a break line at 90° to the side of the tile in abutment with shoulder 71.

Preferably a tile support arm 80 is provided which is movable from a stowed position (FIGS. 1 and 2) to an extended position (FIG. 3) whereat it projects beyond one side of the base 20 to provide added support for a tile being cut, in particular a large tile e.g. 18 inch square tile and also provide an extension to shoulder 71.

Figure 3:
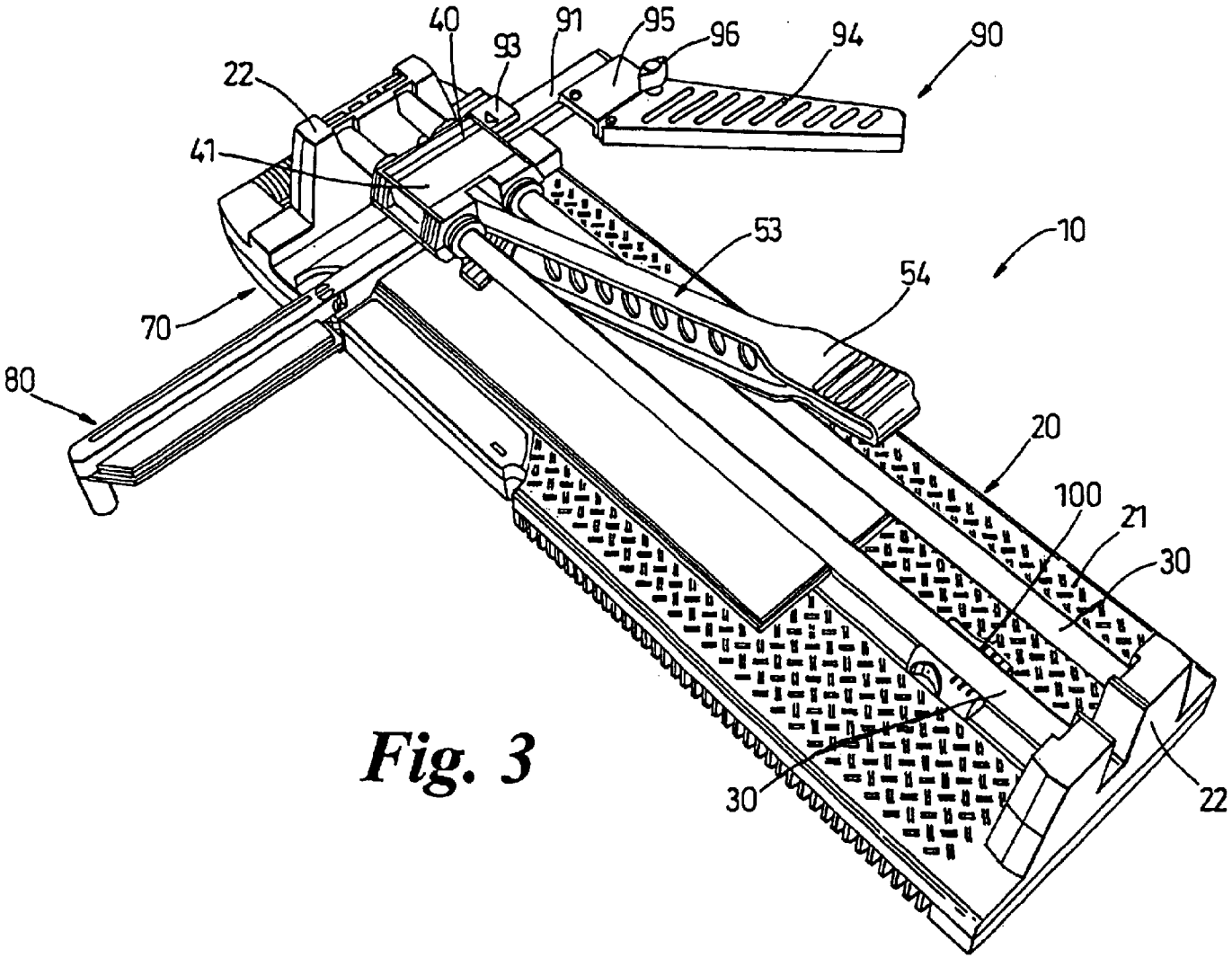
FIG. 3 is a perspective view of the tile cutter of FIG. 1 shown in a different operating mode.
Figure 4:
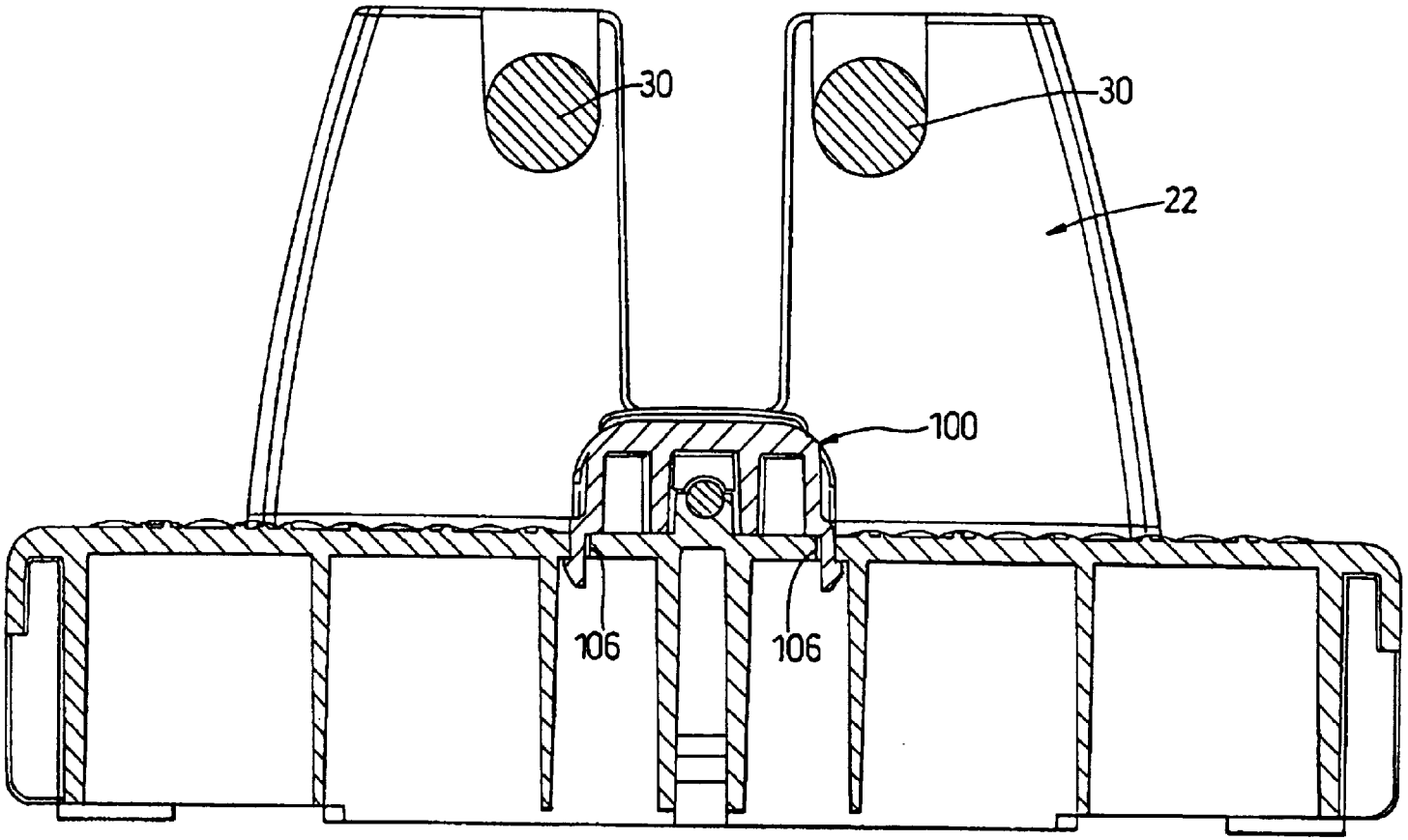
FIG. 4 is a cross-sectional view taken along line IV—IV in FIG. 1.

Preferably the tile support arm 80 is movably mounted relative to the base 20 by a pivotal connection 83 to enable it to move between its stowed position (FIG. 1) whereat it is located within the boundaries of the base 20, to an extended position (as seen in FIG. 3) whereat it projects beyond a side of the base 20.

Preferably an adjustable mitre guide 90 is provided to enable a tile to be positioned at a desired angle relative to the rectilinear path of travel of the cutter wheel 52.

Preferably the mitre guide 90 has an elongate support arm 91 which in slidingly received in a groove 92 formed in the land portion 70. A releasable clamp 93 is provided for preventing axial movement of the arm 91 in groove 92.

A tile mitre guide arm 94 is mounted on the support arm 91 via a bracket 95. The bracket 95 is fixedly mounted on the support arm 91 whilst the mitre guide arm 94 is pivotally mounted on the bracket 95 via a releasable pivot clamp 96 which is preferably defined by a bolt and a hand nut. The mitre guide arm 94 has a rectilinear side wall 97 against which a side of a tile may abut when seated upon the base 20.

Adjustment of the angular position of arm 94 relative to the rectilinear path of travel of cutter wheel 52 is achieved by release of the pivot clamp 96, rotation of the arm 94 relative to bracket 95 and re-clamping of the pivot clamp 96.

The bracket 95 is arranged so as to be movable over the land portion 70 and thereby enable the mitre guide arm 94 to be moved close to the rectilinear path of the cutter wheel.

A common requirement in tile cutting is to cut a tile diagonally from corner to corner.

Preferably the tile cutter 10 of the present invention includes an adjustable clamping jaw 100 mounted on base 20 for clamping a tile to be cut such that opposed corners of the tile are positively located along the rectilinear path of travel of the cutter wheel 52.

Figure 2:
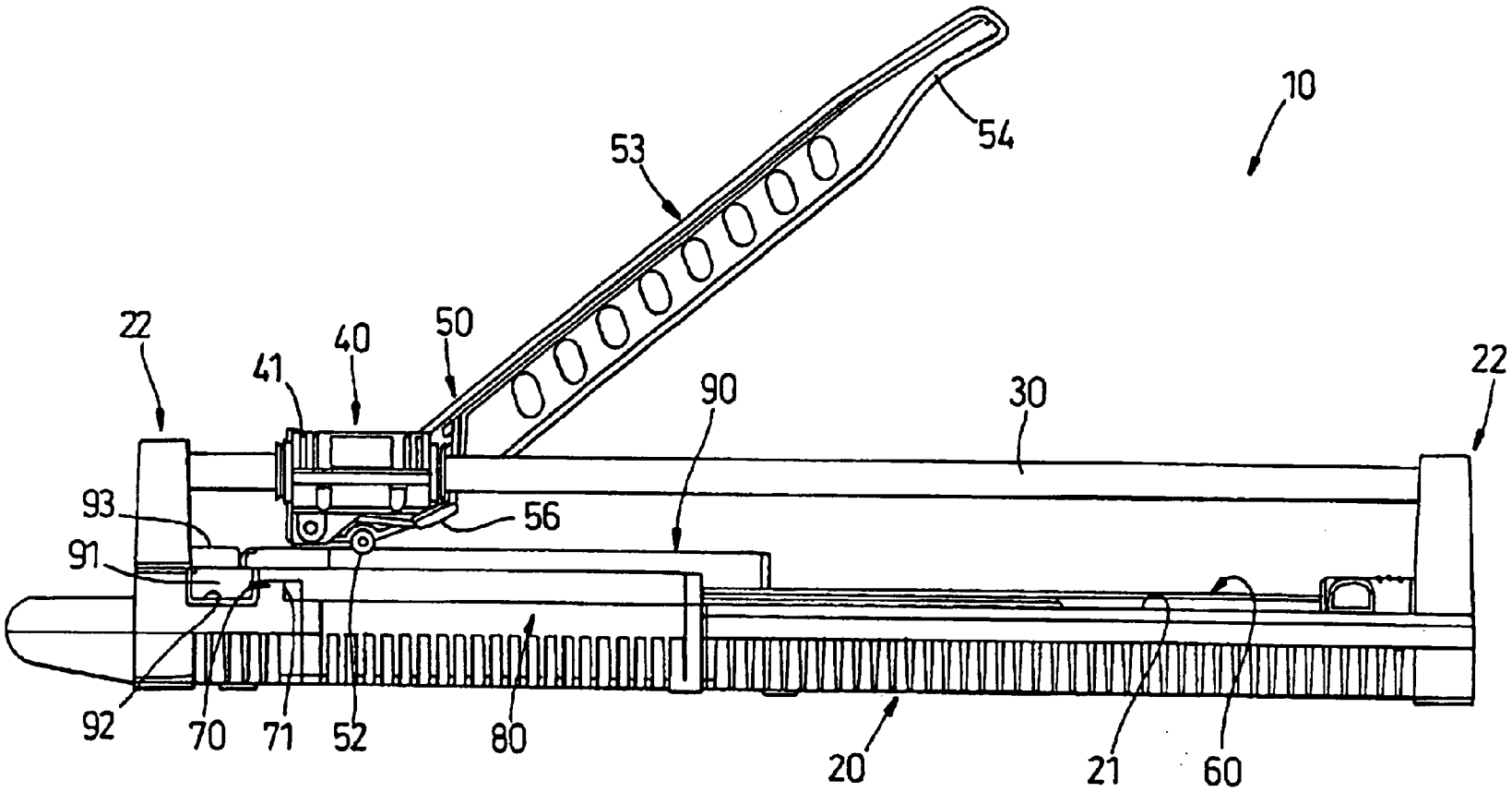
FIG. 2 is a side view of the tile cutter shown in FIG. 1.
Figure 5:
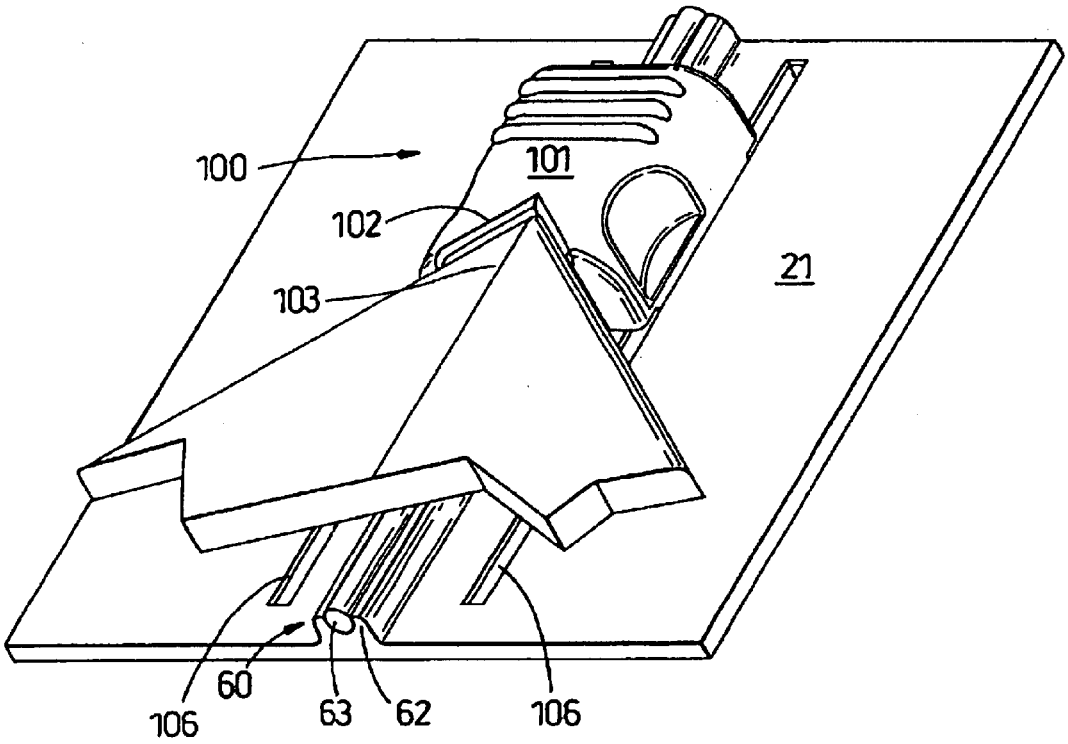
FIG. 5 is a detail perspective view of part of the tile cutter of FIG. 1.

As shown in FIGS. 1 and 5, the clamping jaw 100 includes a jaw body 101 having a V-shaped recess 102 for recessing a corner 103 of a tile.

The body 101 is slidably located in a pair of guide grooves 106 formed in the base 20 for movement along the rectilinear path of the cutter wheel. The shoulder 71 of land portion 70 has a V-shaped recess for receiving an opposed corner of the tile. In use, a tile is placed upon the base 20 with one corner located in recess of the land and the clamp jaw body 101 is adjusted to receive the opposed corner of the tile at recess 102.

In order to positively and accurately guide the cutter wheel 52 along its rectilinear path it is necessary for the carriage body 41 to move along rails 30 without any significant lateral displacement. In addition, it is highly desirable for movement of the carriage body 41 along the rails 30 to be as smooth as possible despite dust and particles from the tiles being cut being deposited onto the rails 30.

In order to achieve these capabilities, the carriage body 41 is preferably movably mounted on each rail 30 by a pair of bearing assemblies 150. Each bearing assembly 150 preferably includes two pairs of opposed bearing rollers 151 which are located on opposite sides of a rail 30.

In an alternative embodiment, each bearing assembly 150 includes lower rollers 151 only, and no upper rollers 151.

Each roller 151 preferably comprises a shaft 153 having a pair of axially spaced bearing wheels 154 mounted thereon so as to be axially fixed relative to the shaft. Each wheel 154 has an inner axial face 170, a circumferential face 171 and a transitional face or corner portion 155 extending between the inner axial face 170 and circumferential face 171.

The transitional face or corner portion 155 defines a contact face for rolling contact between each wheel 154 and rail 30.

The spacing between each wheel 154 of a pair is such that the corner portion 155 of both wheels 154 only makes contact with the rail 30. Thus the opposed corner portions 155 of each pair of wheels 154 when seated upon a rail 30 co-operate with one another to prevent lateral displacement of the roller 151 relative to the rail 30. Preferably the corner portions 155 are chamfered or rounded.

Figure 6:
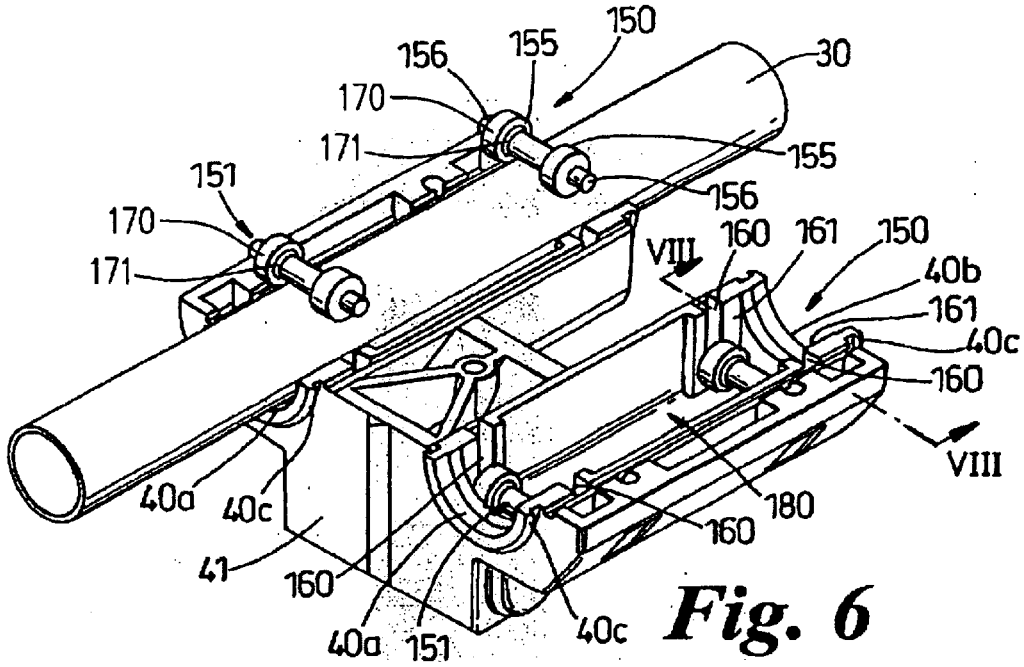
FIG. 6 is a broken away perspective view of part of the tile cutter of FIG. 1.
Figure 7:
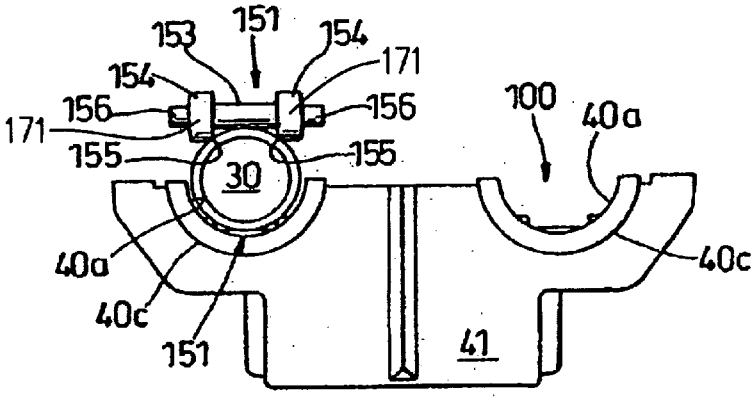
FIG. 7 is an end view of the part shown in FIG. 6.
Figure 8:
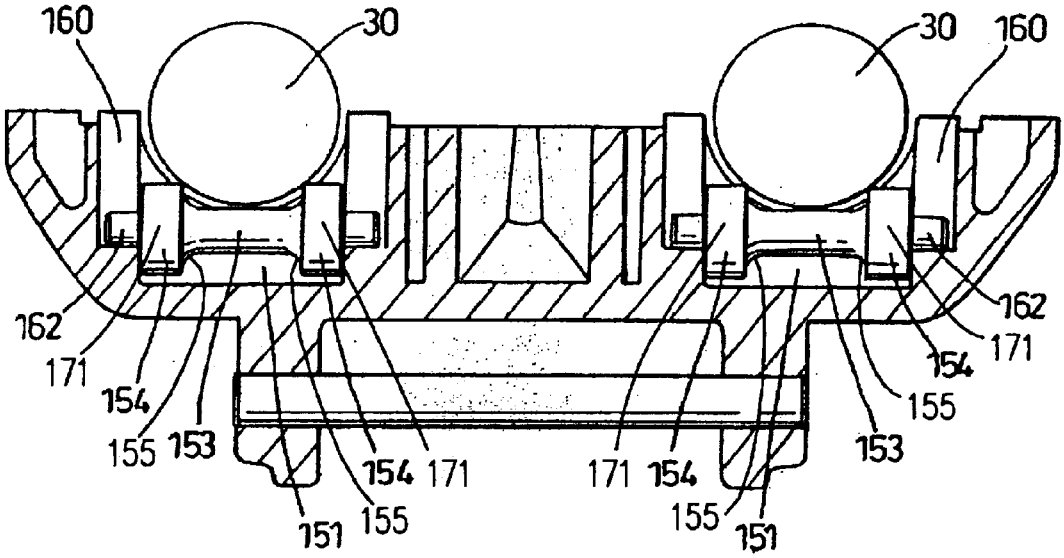
FIG. 8 is a section along lines VIII—VIII in FIG. 6.

Each roller 151 has a shaft extension 156 at each end which is located within a groove 160 formed within the carriage body 41. In FIGS. 6 and 7 only the lower half of carriage body 41 is illustrated.

The grooves 160 accommodating opposite ends of each roller 151 have thrust bearing walls 161 located adjacent thereto against which the outer axial end faces 154*a* of wheels 154 abut. The distance between opposed thrust bearing walls 161*n* is substantially the same or slightly larger than the distance between the outer axial faces 154*a* of the wheels 154. This ensures that there is no significant axial displacement of the roller 151 relative to the carriage body 41 and hence enables the body 41 to move along rails 30 without any significant lateral displacement relative to the rails 30.

Since the corner portion 155 of each wheel 154 forms the only contact between each roller 151 and rail 30, there is a minimal amount of surface contact therebetween and so enables the roller 151 to run along a rail 30 in a smooth manner despite the presence of dust or tile particles.

In an embodiment of the invention in which the rail 30 is polygonal in section, each roller 151 would comprise a ball-like wheel mounted on a shaft.

The carriage body 41 defines internal passageways 180 through which respective rails 30 pass. Accordingly, each rail 30 passes through apertures 40*a*, 40*b* located at the front and rear of the carriage body 41.

Preferably annular seals (not shown) are mounted on the carriage body adjacent each aperture 40*a*, 40*b* for wiping the rails 30 in order to protect the interior of the carriage body 41 from an excessive ingress of dust or tile particles. This also contributes to the wheels 154 contacting a relatively clean portion of the rails 30 and so contributes to the smooth running of the carriage body 41 along rails 30. The annular seals may be formed from a suitable elastomeric material and be in the form of a bellows mounted on annular seat 40*c*.

When the carriage 40 is pulled along the rails 30 by an operative during scoring of a tile, the handle 54 is pulled upwardly in order to apply a downward pressure onto the tile through the cutter wheel 52. This in turn produces an upward biasing force onto carriage body 41. Thus the bottom wall 162 of each groove 161 in the lower half of carriage body 41 is urged upwardly into abutment with the shaft extensions 156 of rollers 151 located therein and these in turn are urged upwardly into abutment with the lower side of the rails 30. Accordingly play between the lower rollers 151, carriage body 41 and rails 30 is removed during the scoring process and the carriage body 41 is positively guided primarily by the lower bearing roller 151. In fact, the upper bearing rollers 151 are not necessary during scoring and breaking of a tile, although they do allow smooth return of the bearing assembly to the far end of the rails 30 after scoring.

Neither the upper, nor the lower rollers 151 are positively based into contact with the rail. This prevents the rollers 151 from "nipping" the rail, which in turn prevents excessive wear to the bearing.

The rollers 151 may be conveniently moulded from a rigid, wear resistant plastics material such as a glass filled Nylon or be made from a suitable metal.

What is claimed is:

1. A tile cutter comprising:

(a) a base having a support surface upon which tiles to be cut may be supported;

(b) a pair of guide rails mounted upon the base, the guide rails being parallel to one another and being spaced from said support surface to enable a tile to be located between the guide rails and said support surface;

(c) a cutter assembly mounted on a carriage, the carriage being movably mounted on said pair of rails so as to guide said cutter assembly along a rectilinear path across said support surface, the cutter assembly being movably mounted on the carriage for downward movement toward said support surface to score a tile located on the support surface when moved along said rectilinear path, and said carriage including a first rotary bearing assembly in rotary contact with one rail and a second rotary bearing assembly in rotary contact with the other rail; and (d) wherein each rotary bearing assembly includes at least one bearing in the form of a roller which is located between the rail and said support surface and which has a shaft on which is mounted at least one wheel which projects radially beyond said shaft and is axially fixed in relation to the shaft, the wheel having an axial face, a circumferential face and a transition face extending between said axial and circumferential faces, wherein only said transition face is in rotary contact with said rail, said transition face being biased away from said support surface into rotary contact with said rail by the carriage being urged upward on application of a downward pressure by the cutter assembly onto said tile being cut.

2. A tile cutter according to claim 1 wherein each of said rails has a round cross-section.

3. A tile cutter according to claim 2 wherein a pair of said wheels are mounted on each shaft, said pair of wheels being axially spaced along the shaft such that the transition faces of both wheels contact said rail.

4. A tile cutter according to claim 1 wherein a pair of said wheels are mounted on each shaft, said pair of wheels being axially spaced along the shaft such that the transition faces of both wheels contact said rail.

5. A tile cutter according to claim 4 wherein each of the first and second bearing assemblies includes at least two of said pairs of rollers which are spaced along the direction of travel of said carriage along said rails.

6. A tile cutter according to claim 5 wherein for each roller, said shaft and said wheels are an integrally formed plastic composition.

7. A tile cutter according to claim 1 wherein said carriage includes a carriage body defining a first internal passageway through which one of said rails passes and a second internal passageway through which the other of said rails passes, said bearing assemblies being located internally of said carriage within said first and second passageways.

8. A tile cutter according to claim 7 wherein each roller has shaft extensions located in grooves formed within said carriage body, each of said grooves having a thrust bearing wall against which a respective outer axial end face of each of said wheels abuts when said carriage body urged in a lateral direction toward said rails and away from said support surface.

9. A tile cutter according to any one of claims 1–4 wherein each of the first and second bearing assemblies includes at least one pair of rollers, each pair of rollers including a first roller located between the rail and said support surface and a second roller located on an opposite side of the rail.

10. A tile cutter according to claim 9 wherein each of the first and second bearing assemblies include at least two of said pairs of rollers which are spaced along the direction of travel of said carriage along said rails.

11. A tile cutter according to claim 10 wherein for each roller said shaft and said wheel(s) are integrally formed.

12. A tile cutter according to claim 11 wherein each roller is made of plastic.

13. A tile cutter according to any one of claims 1–4 wherein each of the first and second bearing assemblies includes a single roller located between the rail and said support surface.

14. A tile cutter according to any one of claims 1–4 wherein for each roller said shaft and said wheel(s) are integrally formed.

15. A tile cutter according to claim 14 wherein each roller is made of plastic.

16. A tile cutter according to any one of claims 1 and 5–8 wherein the base, including formed support bosses carrying said rails, is an integrally formed plastic structure.

* * * * *